United States Patent [19]

Farrar et al.

[11] 4,331,165

[45] May 25, 1982

[54] VENTILATED CIGARETTES

[75] Inventors: David J. Farrar, Dulwich, England; Ralph W. Beck, Richmond, Va.; Edward G. Preston; Robert E. Williams, both of Deptford, England

[73] Assignee: Molins, Ltd., London, England

[21] Appl. No.: 221,334

[22] Filed: Dec. 29, 1980

Related U.S. Application Data

[63] Continuation of Ser. No. 931,013, Aug. 4, 1978, abandoned.

[30] Foreign Application Priority Data

Aug. 5, 1977 [GB] United Kingdom ..... 32970/77
Nov. 1, 1977 [GB] United Kingdom ..... 45313/77

[51] Int. Cl.[3] ..... A24C 1/38; A24C 5/60
[52] U.S. Cl. ..... 131/281; 131/361
[58] Field of Search ..... 131/281, 361, 58, 29 R, 131/88, 94

[56] References Cited

U.S. PATENT DOCUMENTS

| | | | |
|---|---|---|---|
| 2,980,116 | 4/1961 | Schur | 131/15 B X |
| 3,483,873 | 12/1969 | Hinzman | 131/29 X |
| 3,547,134 | 12/1970 | Dock | 131/10 A X |
| 3,701,353 | 10/1972 | Pasquine et al. | 131/23 R |
| 3,805,800 | 4/1974 | Summer | 131/15 B X |
| 4,034,765 | 7/1977 | Van Hall | 131/10 A |
| 4,082,098 | 4/1978 | Owens, Jr. | 131/15 B X |
| 4,090,826 | 5/1978 | Hinzmann | 131/170 R X |

FOREIGN PATENT DOCUMENTS

| | | | |
|---|---|---|---|
| 938902 | 10/1963 | United Kingdom | 131/15 B |

*Primary Examiner*—Stephen C. Pellegrino
*Attorney, Agent, or Firm*—Craig and Antonelli

[57] ABSTRACT

Ventilated cigarettes are made by perforating the wrapper of each filter over an area which lies within preformed perforations in the uniting band joining the filter to the tobacco rod. The filter wrappers may be perforated by pins on a rolling plate and fluted drum between which filter portions cut from longer filter rods are rolled to stagger the portions so that they can then be pushed into a single row.

24 Claims, 9 Drawing Figures

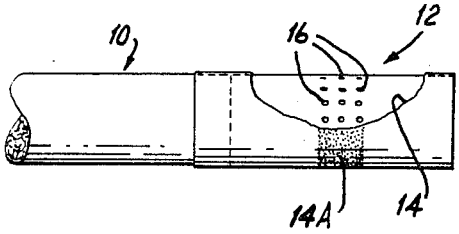
Fig. 1.
Fig. 2.
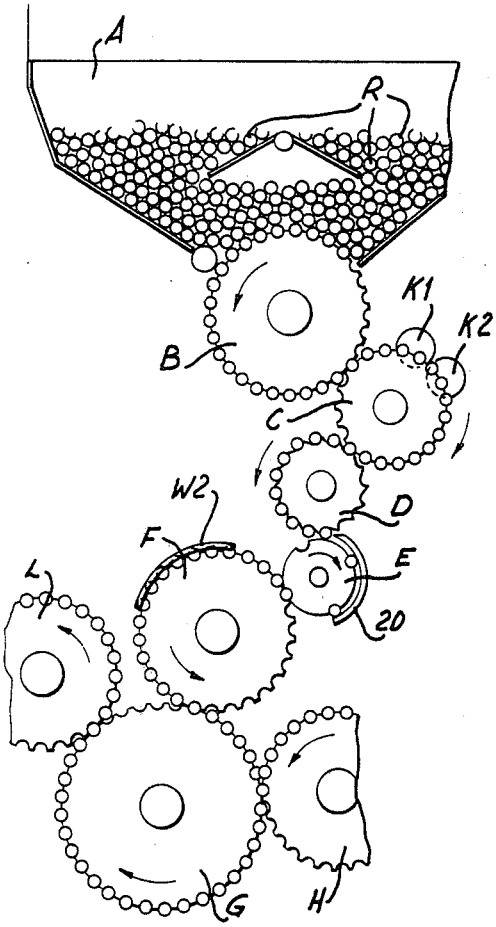
Fig. 3.
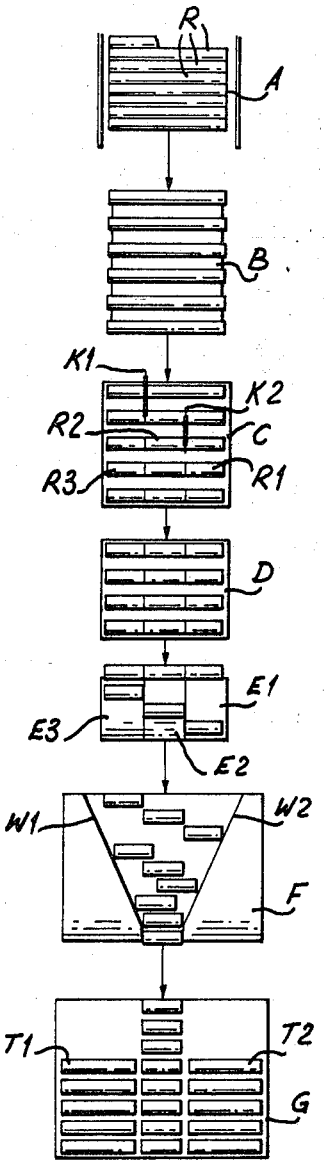

VENTILATED CIGARETTES

This is a continuation of application Ser. No. 931,013 filed Aug. 4, 1978, now abandoned.

This invention is concerned with the manufacture of ventilated cigarettes; that is to say, filter-tipped cigarettes which allow air from the atmosphere to be drawn in through the side of the filter to mix with smoke taken in by the smoker.

One way of making ventilated cigarettes is described in British patent specification No. 1,250,832. According to that specification, completed filter cigarettes are perforated by being rolled with the aid of a rolling member having pins which form perforations in the filter portion of the cigarette. For that purpose, the pins must penetrate the uniting band which joins the tobacco portion to the filter, and also the wrapping material around the filter portion itself.

According to the present invention, in the maufacture of ventilated cigarettes, filter portions are joined to wrapped tobacco portions by pre-perforated web portions which are wrapped around the filter portions and overlap and are secured to ends of the tobacco portions, the wrapper of each tobacco portion, before it is surrounded by the associated uniting band, being perforated over an area which lies within the perforations in the uniting band when the cigarette is complete.

The filter wrappers are preferably mechanically perforated. This can be achieved by rolling the filters with the aid of a rolling member carrying pins to perforate the wrapper. One advantage of such an arrangement over the aforementioned British system described in the patent specification is that the pins do not need to penetrate the uniting band (which is commonly of a more abrasive material) and therefore have a longer life; furthermore, the tendency for the pin-perforated holes to be somewhat unattractive (which is a disadvantage in the system according to the above British patent specification) is of no account in the present invention since those holes are covered by the uniting band; the uneveness of the filter wrapper which results from the indentations formed by the pins may even by an advantage of the present invention in regard to maximizing the ventilation air flow.

The perforations in the uniting band may be formed by sparking (or by means of a laser) in large quantities and with a small diameter so as to be substantially invisible. This sparking or laser perforation may be carried out during the manufacture of the reels of uniting band material, or on the filter attachment machine.

In one preferred arrangement, filter rods of double unit length cut from a longer rod are perforated by means of a number of sets of pins (e.g. six, as described with reference to the drawings) before being formed into a single row; with such an arrangement the life of the pins is increased (e.g. sixfold) because the work of preforating the filter wrappers is shared by all the sets of pins.

Examples of ways of making ventilated filter cigarettes according to this invention will now be described with reference to the accompanying drawings. In these drawings:

FIG. 1 is a partly sectioned side view of a ventilated filter cigarette according to this invention;

FIG. 2 is a diagrammatic front view of a filter attachment machine for use in the manufacture of the cigarettes;

FIG. 3 is a diagrammatic developed side view of the machine shown in FIG. 2;

Figure 4:
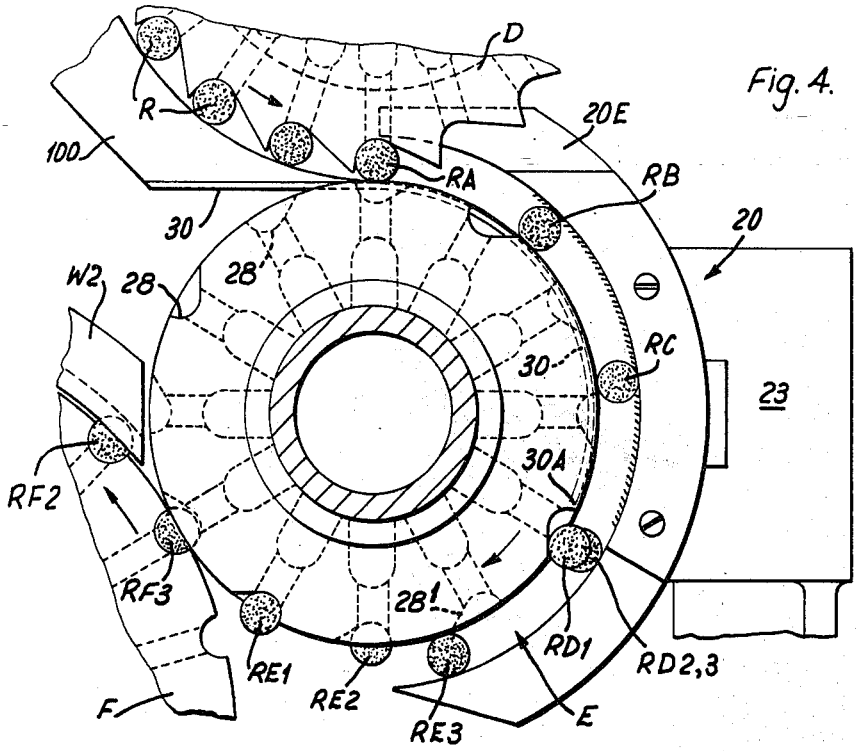
FIG. 4 is an enlargement in the area of the drum E in FIG. 2.

FIG. 1 shows a ventilated filter cigarette comprising a tobacco portion 10 and a filter portion 12. The filter portion is joined to the tobacco portion by a uniting band 14 which surrounds the entire filter portion and overlaps and is secured to the adjacent end of the tobacco portion. The uniting band has, along a region lying approximately midway between the ends of the filter portion, an area 14A which is perforated, for example by sparking, to allow ventilation air to flow into the filter. Within the perforated area 14A of the uniting band, the wrapper of the filter portion has a number of circumferentially extending rows of indentations forming perforations 16; only three rows are shown, but there may in practice be more.

Instead of the perforated area of the uniting band having numerous very small holes, it could have one or more rows of discreet, somewhat larger holes.

FIGS. 2 to 6 show one way in which the perforations in the wrappers of the filter portions may be formed in a filter attachment machine.

FIGS. 2 and 3 show part of the general arrangement of the machine, which is similar to the Molins PA 8 filter attachment machine. The machine includes a hopper A which is arranged to receive filter rods R which are of multiple-unit length. Each rod, in the example shown, is six times the length of the filter portion which forms part of each completed filter cigarette.

The rods R are fed from the hopper A by a fluted drum B and are then received by a fluted drum C. Disc knives K1 and K2 adjacent to the drum C cut each rod R into three equal portions R1, R2 and R3 each of which comprises a double-length filter portion. Each group consisting of portions R1, R2, R3 remains axially aligned while being tranferred from the drum C to a fluted drum D. The filter portions R1, R2 and R3 are then received by a drum E which is in three parts arranged to receive the respective filter portions in staggered formation, as shown in FIG. 3; this will be further described with reference to FIG. 4, which is an enlargement mainly of the drum E.

The staggered filter portions are then received by a drum F and are pushed into a single row by converging fixed walls W1 and W2 extending around part of the drum F. Thus a single row of double-length filter portions is delivered to a fluted drum G which also receives, in each of its flutes, two tobacco-filled rods T1 and T2 adjacent to opposite ends of each double filter portion. The tobacco rods are delivered to the drum G by a drum H (FIG. 2). Each assembly consisting of a pair of tobacco portions T1 and T2 with an interposed double-length filter portion is received from the drum G by a fluted drum L which delivers the assemblies to a rolling drum by which adhesive-coated uniting bands are wrapped around the filter portions and around adjacent ends of the tobacco portions. The resulting double cigarettes are finally cut through the middle to form individual filter cigarettes.

In order not to close the perforations in the uniting bands, adhesive is preferably not applied to the uniting bands in the area of the perforations, except at the edges of the bands.

A description of a possible arrangement of the rolling drum is contained in our British Patent Application No. 40449/74 (and corresponding German Offenlegungsschrift No. 25 40 154), in which the fluted drum 2 corresponds to drum L in the present specification.

The arrangement whereby the filter portions R1, R2 and R3 are staggered on the drum E is basically as described in our U.S. Pat. No. 3,405,579, to which reference is directed in its entirety.

The drum E comprises three axially spaced parts E1, E2 and E3 which receive respectively the filter portions R1, R2 and R3. FIG. 4 shows in elevation the drum E and associated parts. Filter groups R (already cut) are delivered to the drum E by the drum D, being stripped from the drum D by three fingers 20E extending from three sections 20' of a rolling plate 20. The three parts 20' of the rolling plate cooperate respectively with parts E1, E2 and E3 of drum E and are carried by a bracket 23. The drum D has deep circumferential grooves into which the fingers 20E extend to strip the filter rods from the drum D in a known manner.

After transfer to the drum E, the rod sections R1, R2 and R3 are staggered and perforated in the manner described below.

Figure 5:
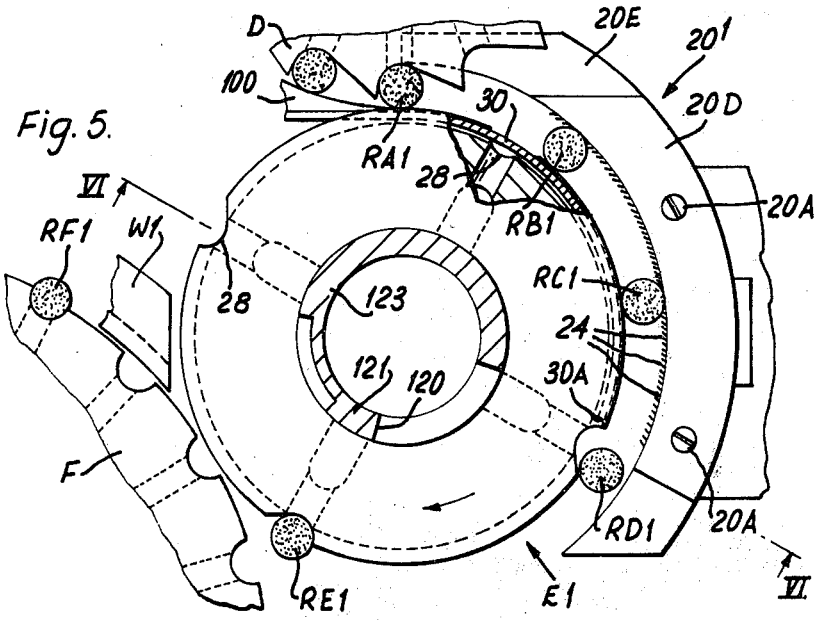
FIG. 5 shows drum section E1 in cross-section.
Figure 6:
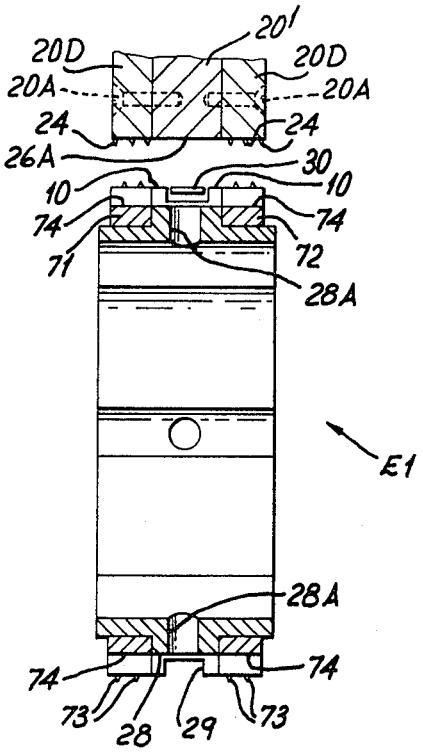
FIG. 6 is a section on the line VI—VI in FIG. 5, but showing a slightly modified form of the drum section E1.

The three sections E1, E2 and E3 of the drum E are all identical. Each has four flutes 28 at 90° intervals, as shown in FIG. 5. However, the flutes of the three drum sections are evenly staggered; consequently in FIG. 4 the flutes of all three drum sections are shown, in dotted outline, at 30° intervals. This enables the three portions of each filter rod to be rolled backwards into staggered positions as already mentioned. Each rolling plate section 20' has, on each side of it, an arcuate member 20D which carries three rows of pins 24 and is secured in position by screws 20A. Also, as shown in FIG. 6, but not in FIGS. 4 and 5, each section E1, E2 and E3 of the drum preferably has a replaceable annular member 71 at each end carrying two rows of pins 73 interrupted by recesses 74 forming extensions of the flutes 28 in the drum. The positions of the pins are such that the pins 73 form rows of holes lying between the rows of holes formed by the pins 24.

Each filter portion is rolled through at least 2 revolutions while being perforated by the pins. While this rolling is taking place, the filter portions are prevented from dropping into the flutes 28 by fixed curved fingers 30. These fingers are carried by a guide 100 associated with the drum D and extend into circumferential grooves 29 in the drum sections E1, E2 and E3 (see for example FIG. 6); the outer surface of each finger is slightly below the outer surface of the drum so as not to interfere with the filters when rolling on the drums.

FIG. 4 shows one group of filter portions RA at the transfer point between the drums D and E. The preceding group RB has just started to be perforated. Group RC is about half way through the perforation operation. Group RD has passed the pins (i.e. perforation has been completed and has also passed the end 30A; consequently portion RD1 of that group is beginning to drop into the adjacent flute of drum E1. Portions RE1 and RE2 of the preceding group have already dropped into flutes in drums E1 and E2, while portion RE3 is about to be caught up by flute 28' of drum E3. The trailing portion RF3 of the preceding group is being transferred to the drum F, the portions RF1 and RF2 of the group already having been transferred to drum F.

After entering a flute 28, each filter portion is held in the flute by suction supplied via a passage 28A, and via a slot 120 in a sleeve valve 121, from a suction space 123.

Filter rolling surfaces 10 and 26A respectively on the drum and rolling plate (see FIG. 6) may be coated with a rough material to provide a good grip.

It should be noted that each rod portion, while being rolled, is slightly compressed between the drum and the rolling plate 20. The pins 24 may, for example, project radially inwards from the inner rolling face of the plate 20 by between 0.025 and 0.030 inches, and may be arranged to form holes of about 0.008 inch diameter; the same may apply to the pins 73. Preferably, however the pins are inclined to the corresponding radius by about 20° so as to enter the wrapper approximately at right angles.

It should also be understood that the drum E rotates with a peripheral velocity which is considerably greater than that of the drum D, since the axes of the rods, during rolling, move at one half the peripheral velocity of the drum E. The speed of rotation of drum E is in fact five times that of drum D. The peripheral velocity of the drum F is approximately equal to that of the drum E.

The rolling plate 20 may be releasably mounted so that it can move away from the drum E, against the action of a holding spring, if a jam (i.e., a build-up of filter portions) occurs between the rolling plate and the drum.

We have found that it is desirable to form numerous holes in a fairly narrow band extending around each filter wrapper. For example, by perforating each filter while rolling it through a number of revolutions, it is possible to form approximately 300 or more perforations; the total number may be as high as 600. This is facilitated by the provision of pins on the drums E1, E2 and E3, as well as on the rolling fingers 20.

If the pins are set very close together then there is a danger that the pressure of each pin point on the filter wrapper is insufficient to penetrate the wrapper. For that purpose, the point of each pin needs to be sharp. The shape of the point may be conical; alternatively, each point may be formed by grinding the pin to form four converging facets; the facets may come to a sharp point or may define an edge with sharp points at both ends.

The pins on the rolling fingers and/or on the drum sections may be at varying heights. For example, the tips of the pins may be at distances from the drum or rolling plate surface ranging between 1 and 2 mm.

In place of the perforating pins 24, rotating disc knives may be used to cut slits in the filter wrappers while they roll past the knives. For example, each knife may project radially inwards beyond the rolling surface of the associated rolling plate by a distance of about 0.75 to 1 mm. Each plate section may have, on each side, a number of such knives spaced around the axis of the drum E to produce a number of circumferentially spaced slits in the wrapper of each filter portion. For example, there may be three parallel driven spindles which pass through the rolling plate at circumferentially spaced positions and carry stacks of knives adjacent to opposite sides of each plate section; the spindles would be so positioned that each filter portion is slit partially around its circumference at three circumferentially spaced positions, i.e. receives three sets of multiple slits; each stack of knives may be machined from a single piece of metal.

Provision may be made for sharpening the knives continuously or from time to time. Alternatively, the knives may be made of a highly wear-resistant material (e.g. tungsten carbide), the knives being simply replaced when necessary.

Figure 7:
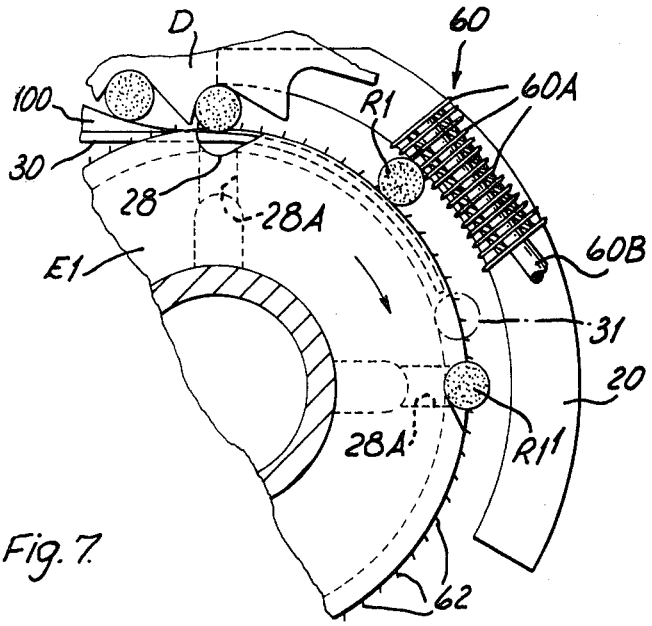
FIG. 7 is similar to FIG. 6 but shows a modified form of perforation device.

Instead of cutting slits in the wrapper of the filter, each knife may have a serrated edge which mills away part of the wrapper. FIG. 7 shows an example of such an arrangement.

FIG. 7 shows one drum section E1 (as in the previous example). While being rolled on the surface of the drum E1 by means of the rolling plate 20, each filter portion is formed with a circumferentially extending row of milled grooves by means of a milling device 60, each groove being parallel to the axis of the filter. The device 60 comprises a number of axially spaced milling discs 60A mounted on a shaft 60B of which the axis lies in a plane normal to the axis of the drum E1. The disc diameters vary so that each disc projects slightly into the gap between the drum E1 and the rolling surface of the plate 20. Each disc 60A may have a serrated or other suitable edge for milling a shallow groove in the surface of the filter rod as it passes by.

In addition the drum E1 may have groups of pins 62 to provide additional perforations. The pins are inclined as described with reference to the previous example.

It will be understood that similar milling devices 60 are provided wherever necessary to form perforations in the filter portions.

Another possibility is as follows. Each of the spindles carrying the knives K1 and K2 may also carry axially spaced sets of smaller-diameter knives or milling tools for cutting slits or for milling grooves part way into the filter. Slitting or milling of the filters may alternatively be carried out at any other stage during their conveyance between the filter rod forming device and the filter assembly station. This applies especially while the filters are being conveyed by fluted drums; for example, circumferential slits may be formed on one side while the filters are on one drum, and on the other side while on another drum. Alternatively, longitudinal slits or grooves may be formed while the filter rod (either while still continuous or after cutting) is moving longitudinally.

Another possibility is that the filter rods, e.g. while moving slowly on the drum B, may pass a stack of serrated discs mounted on a shaft which is driven so that the edges of the serrations penetrate the filter wrapper and drive the filter about its axis so as to form perforations substantially all the way around the wrapper; in other words, the filters are made to spin in the flutes of the drum, which flutes for this purpose would be highly polished. Alternatively, a rolling plate with pins may be provided to spin the filter rods in their flutes while perforating them. The flutes may have ports through which suction is applied for holding the filters in the flutes while the filters are not being spun, and pressure air may be supplied to those ports during spinning to produce an elementary air bearing. During spinning, the filters may be held slightly away from the bottoms of the flutes by arcuate stationary fingers extending into circumferentially extending grooves in the drum, so that the filters rub substantially only on the fingers, which may have low-friction coatings on their outer surfaces. For example, the arcuate fingers may extend obliquely downwardly between the drums B and C (FIG. 2) and may first lift the filters slightly from the drum B (for the purpose of spinning) and then help to strip the filters from the drum B so that they then enter the flutes in the drum C.

Figure 8:
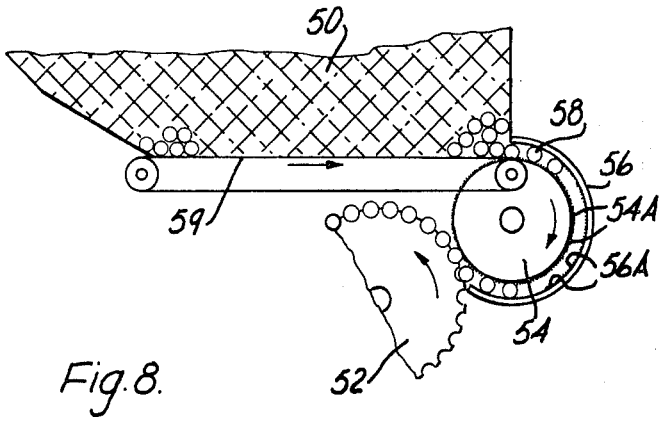
FIGS. 8 and 9 are diagrammatic front views of parts of two different filter attachment machines.

FIG. 8 of the accompanying drawings shows another possible way of perforating the filters. A filter hopper 50 (corresponding to hopper A in FIG. 2) delivers filter rods to a fluted drum 52 (corresponding to drum B of FIG. 2). Instead of entering directly into the flutes of the drum 52, the filter rods pass between a rolling drum 54 and a rolling plate 56 both of which have sets of pins 54A and 56A respectively for forming bands of perforations at appropriate axially spaced positions around each filter rod. Alternatively, the pins 54A or 56A may be omitted. It will be seen that each filter rod 58 is rolled through several revolutions while being perforated. To ensure an unbroken succession of filter rods in the rolling space between the drum 54 and plate 58, conveyor bands 59 are provided; these form the floor of the hopper and support opposite ends of the filters so as to move the filters towards the drum 54. The peripheral speed of the drum 54 is greater than the speed of the bands 59, so that the filter rods are spaced apart as they travel round the drum.

Instead of entering directly into the flutes of the drum 52, the filters may, on leaving the drum 54, pass into another hopper space (equivalent to hopper A in FIG. 2) from which they are delivered by a fluted drum corresponding to drum B in FIG. 2.

Another possible way of perforating the filter rods is as follows. The filter rods may be fed into the filter hopper in the manner of any one of the examples described in U.S. Pat. No. Re. 28,383 (of W. Rudszinat); however instead of the filters being driven into the filter hopper by being gripped on both sides by bands, they may be driven forward by means of bands on one side in cooperation with a stationary plate on the other side, so that the bands convey the filters with a rolling action; and the plate may be formed with pins or other means for perforating the filters while they are rolling.

Figure 9:
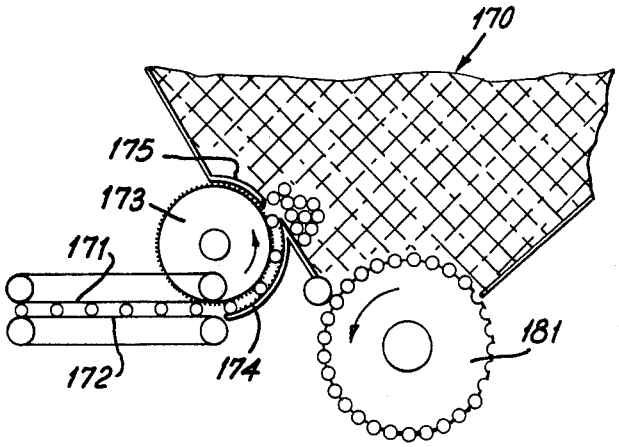

FIG. 9 shows a modification of the last-mentioned arrangement. It includes a filter rod hopper 170 and drum 181 (corresponding basically to the hopper A and drum B in FIG. 2). The rods are fed into the hopper by a device comprising bands or sets of bands 171, 172 which deliver the rods (without rolling) into a gap between a drum 173 and a fixed plate 174. The drum 173 and plate 174 both have sets of pins whereby the rods are perforated while being rolled between the drum and the plate; alternatively, the pins on either the drum or the plate may be omitted. A cover plate 175 over the drum 173 holds the rods out of contact with the drum 173 once they are in the hopper.

Another way of perforating the filter rods is as follows. On being transferred from one fluted drum to another (e.g., from drum B to drum C, or from drum E to drum F in FIG. 2) the filter rods or portions may initially be held out of the flutes of the receiving drum by means of one or more fingers like the fingers 30 shown in FIGS. 4 and 5. While that is happening, the rods are rolled by a pin-carrying rolling plate to form perforations, where necessary, in basically the manner described above with reference to FIGS. 4 and 5. As before, the surface of the receiving drum may also have outwardly-projecting pins to form additional perforations. Also, as before, the filter rods will drop into the flutes of the receiving drums after passing the downstream end of the finger or fingers.

This method of perforation may also, in principle, be applied to finished cigarettes or to the double cigarettes before they are cut through the middle to form individual filter cigarettes. The means for perforating the rods while they are rolling may take various forms; it may be a non-mechanical device, e.g. a laser.

We claim:

1. In a method of making ventilated cigarettes in which filter portions are joined to wrapped tobacco portions by pre-perforated web portions forming uniting bands which are wrapped around the filter portions and overlap and are secured to the ends of the tobacco portions, the improvement comprising the step of heavily perforating the wrappers of complete filter rods used to form the said filter portions with a large number of perforations, before the filter portions are surrounded by the associated uniting bands, over areas which are to lie within the perforations in the uniting bands when the cigarettes are complete, the operation by which the wrappers of the filter portions are perforated comprising perforating in such a way as to make the surface of the filter portions uneven in the area of the perforations to create spaces between a wrapper and its overlying uniting band which maximize the ventilation air flow to the filter portion.

2. A method according to claim 1 in which the wrappers of the filter portions are perforated by pins pressed through the wrappers so as to form indentations.

3. A method according to claim 2 wherein said perforating step includes rolling the filter rods along and between at least first and second parts in both of which parts the pins are mounted to perforate said filter rods.

4. A method according to claim 2 in which there are a number of rows of pins, and the filter portions are rolled through a number of revolutions over the pins so as to form a large number of perforations covering a predetermined area.

5. A method of making ventilated cigarettes comprising the steps of cutting multiple-length filter portions into shorter sections; staggering the sections with respect to each other by rolling the sections backwards between a drum and a rolling plate by different amounts; perforating the filter sections so as to form indentations in the wrappers, during that rolling back operation, by pins on at least one of the rolling plate and the drum; pushing the perforated filter sections into a single line; and joining the filter sections to wrapped tobacco portions by pre-perforated web portions which are wrapped around the filter portions and overlap and are secured to ends of the tobacco portions.

6. A method according to claim 5 in which there are a number of rows of pins, and the filter portions are rolled through a number of revolutions over the pins so as to form a large number of perforations.

7. In a machine for making ventilated cigarettes wherein filter sections are joined to tobacco portions by wrapping around the filter sections pre-perforated uniting bands which overlap and are secured to the ends of the tobacco portions, including parts along which filter sections are arranged to roll along a given path the improvement comprising perforating means arranged to heavily perforate the wrappers of the filter sections before the filter sections are joined to the tobacco portions, including a member mounted adjacent to said path and carrying pins which are pressed through the wrappers of the filter sections, said pins being mounted on a rotating drum and along a cooperating fixed rolling plate between which the filter sections roll by the cooperative action of the drum and rolling plate.

8. Apparatus for making ventilated cigarettes comprising means for receiving multiple-length filter portions; means for cutting the filter portions into shorter sections; a drum and a rolling plate disposed adjacent said receiving means to receive the filter portions therebetween; means for driving the drum so as to move the filter portions along said rolling plate so that the filter portions are rolled backwards into flutes in the drum in staggered positions; perforating means for perforating the wrappers of the filter sections including pins mounted on the rolling plate and on the drum so as to be pressed through the wrappers of the filter sections during rolling; means for pushing the cut filter portions into a single line; and means for joining the filter sections to tobacco portions by wrapping around the filter sections pre-perforated uniting bands which overlap and are secured to the ends of the tobacco portions.

9. Apparatus according to claim 8 in which the rolling plate comprises a plurality of parts cooperating with the respective sections of the filter sections, each part of the rolling plate having on each side of it a replaceable member carrying a set of the pins.

10. Apparatus according to claim 9 in which the drum comprises a plurality of parts each carrying at each end a replaceable annular member carrying a set of pins.

11. Apparatus according to claims 7, 8, 9 or 10 in which the drum has flutes into which the filter sections drop after being rolled, and at least one circumferentially-extending recess into which a curved fixed finger projects to hold the filter sections out of the flutes until rolling has been completed.

12. Apparatus according to claims 7, 8, 9 or 10 in which there are a number of rows of pins, and the filter sections are rolled through a number of revolutions over the pins so as to form a large number of perforations.

13. In apparatus for making ventilated cigarettes wherein filter sections are joined to tobacco portions by wrapping around the filter sections pre-perforated uniting bands which overlap and are secured to the ends of the tobacco portions, the improvement comprising perforating means arranged to heavily perforate the wrappers of the filter sections before the filter sections are joined to the tobacco portions, and in which the perforating means comprises a rotary cutting device which slits the wrappers of the filter sections.

14. Apparatus according to claim 13 in which the cutting device comprises a number of cutting or milling discs which engage the filter sections.

15. Apparatus for perforating rods of the cigarette industry, comprising a first fluted drum which transfers the rods to a second fluted drum, characterized by one or more curved fixedly-mounted fingers which extend tangentially into a circumferential recess in the second drum so as initially to prevent the rods from dropping into one of the flutes in the second drum, a rolling member adjacent to the second drum for rolling the rods on the surface of the second drum, and perforating means for forming perforations at various points around the circumference of the rods while they are rolling.

16. Apparatus according to claim 15 in which said perforating means comprises means for mechanically perforating and roughening the circumferential surfaces of the rods.

17. Apparatus according to claim 16 in which the perforating device comprises pins on the rolling member and pins on the outer surface of the second drum.

18. Apparatus according to claims 15, 16 or 17 including means to transfer a number of axially-aligned rods and in which the second drum includes means to receive the rods in its flutes in staggered positions.

19. In apparatus for making ventilated cigarettes wherein filter sections are joined to tobacco portions by wrapping around the filter sections pre-perforated uniting bands which overlap and are secured to the ends of the tobacco portions, the improvement comprising perforating means arranged to heavily perforate the wrappers of the filter sections before the filter sections are joined to the tobacco portions, said perforating means including means to make the surface of the filter sections uneven in the area of the perforations to create spaces between a wrapper and its overlying uniting band which maximize the ventilation air flow to the filter portion.

20. In a method of making ventilated cigarettes in which wrapped filter portions are joined to wrapped tobacco portions by pre-perforated web portions forming uniting bands which are wrapped around the filter portions and overlap and are secured to the ends of the tobacco portions, the improvement comprising the step of heavily perforating the wrappers of the completed filter rods before the filter portions are surrounded by the associated uniting bands, over areas which are to lie within the perforations in the uniting bands when the cigarettes are complete, said step comprising inserting pins through the wrappers of the filter rods and then withdrawing the pins in directions such as to tear the wrappers outwardly as the pins are withdrawn.

21. In a method of making ventilated cigarettes in which filter portions are joined to wrapped tobacco portions by pre-perforated web portions forming uniting bands which are wrapped around the filter portions and overlap and are secured to the ends of the tobacco portions, the improvement comprising the step of heavily perforating the wrappers of complete filter rods used to form the said filter portions with a large number of perforations, before the filter portions are surrounded by the associated uniting bands, over areas which are to lie within the perforations in the uniting bands when the cigarettes are complete, in which the filter rods are perforated by being rolled between two members of which at least one has pins which are forwardly-inclined with respect to the direction of movement of the said member relative to the filter portions during said rolling motion, so that the pins tear the wrappers of the filter rods as they withdraw after penetrating the wrappers.

22. In a machine for making ventilated cigarettes wherein wrapped filter sections are joined to wrapped tobacco portions by wrapping around the filter sections pre-perforated uniting bands which overlap and are secured to the ends of the tobacco portions, the improvement comprising means arranged to heavily perforate the wrappers of the filter sections before the filter sections are joined to the tobacco portions, said perforating means comprising pins and means for inserting the pins through the wrappers of the filter sections and for then withdrawing the pins in directions such as to tear the wrappers outwardly as the pins are withdrawn.

23. A machine according to claim 22 in which the perforating means comprises means for rolling the filter sections between two members of which at least one has pins which are forwardly-inclined with respect to the direction of movement of the said member relative to the filter sections during said rolling motion so that the pins tear the wrappers of the filter sections as they withdraw after penetrating the wrappers.

24. A ventilated cigarette comprising a tobacco portion joined to a wrapped filter portion by a uniting band which surrounds the filter portion and overlaps and is secured to the end of the tobacco portion, the uniting band having an air-pervious area within which the wrapper of the filter portion has perforations formed at least partly by portions of the wrapper being torn outwards so as to provide the wrapper with an uneven surface in contact with the said uniting band to create spaces therebetween which maximize the ventilation air flow.

* * * * *